United States Patent [19]

Duvall

[11] 4,395,127

[45] Jul. 26, 1983

[54] OPTICAL PAPER DETECTOR

[75] Inventor: Kenneth R. Duvall, Washington, D.C.

[73] Assignee: The United States of America as represented by the Secretary of the Treasury, Washington, D.C.

[21] Appl. No.: 186,364

[22] Filed: Sep. 11, 1980

[51] Int. Cl.[3] ..... G01N 21/89; G01B 11/06

[52] U.S. Cl. ..... 356/430; 250/572; 250/222.1

[58] Field of Search ..... 356/429, 430, 431, 239; 250/222, 223 R, 562, 563, 571, 572

[56] References Cited

U.S. PATENT DOCUMENTS 3,589,816 6/1971 Sugaya ..... 356/430
3,873,843 3/1975 Martin ..... 250/222 R X
3,891,857 6/1975 Wiklund ..... 250/571 X
3,922,557 11/1975 Carnes, Jr. ..... 250/571 X
4,194,840 3/1980 Lucas et al. ..... 356/429

*Primary Examiner*—Vincent P. McGraw
*Attorney, Agent, or Firm*—Joseph A. Hill; Thomas J. Byrnes; Harry E. Barlow

[57] ABSTRACT

An optical paper detector for use in conjunction with a printing press for sensing the undesirable condition of more than a single sheet of paper being simultaneously fed to the press. The optical paper detector is comprised of an array of wide angle phototransistors connected in parallel which uniformly sense light transmittance through the paper over a relatively large and continuous area to provide an averaging effect so that the optical paper detector is relatively insensitive to local variations in light transmittance. The optical paper detector is equipped with a flat cover that permits flush mounting and provides a self-cleaning wiping action.

8 Claims, 8 Drawing Figures

OPTICAL PAPER DETECTOR

GOVERNMENT LICENSE

The invention described herein may be manufactured and used by or for the Government of the United States of America for Governmental purposes without the payment of any royalties thereon or therefor.

BACKGROUND OF THE INVENTION

This invention relates to an optical paper detector and more particularly is directed to a phototransistor array for detecting multiple sheets of paper in a printing press feed system. It is particularly constructed for use by the Bureau of Engraving and Printing for detecting the presence of more than one sheet of paper in a printing press feed system during the printing of paper money.

In the past, the presence of more than one sheet of paper currency was sensed by a small lens system positioned near the paper feed mechanism of the printing machines. A small spot was customarily sensed on the area of the paper which forms the border of two adjacent paper bills. This area of the paper is not printed during either the printing operation or the overprinting operation whereby seals and serial numbers are added. This area is also where the cuts are made to form individual bills from a sheet of bills.

The smallness of the sensing area used in conventional systems can create problems since even a slight variation in paper density or paper alignment in the sensing area will effect the reading produced. Variations in paper density alone can vary be as much as 40% the amount of light striking the optical paper detector. Misalignment of the paper can result in printed material being inadvertently placed within the sensing area; this is particularly true during overprinting where the seals and serial numbers are printed on partially printed bills. Such misalignment can drastically affect the amount of light from the source reaching the optical paper detector. Variations in the density of the paper or variations in the paper alignment or a combination of these two types of variations can cause false triggering thereby resulting in an unnecessary and undesireable feed interruption.

SUMMARY OF THE INVENTION

The present invention is directed to an arrangement for avoiding these difficulties through the use of a relatively wide area photosensitive array which substantially increases the sensing area. The increased sensing area produces an averaging effect whereby slight variations in the paper density or slight misalignment of the paper during the feeding process do not result in a significant variation in the electrical output from the phototransistors. The system is used without a lens and preferably with a quartz or pyrex glass cover so that it may be flush mounted with the feedboard and is self-cleaning as the paper passes over it in a wiping action. This self-cleaning feature greatly reduces or eliminates buildups of paper, dust, dirt and the like which tended to cause problems with previous optical systems.

In the present invention, an array of phototransistors is positioned beneath a sheet of paper to detect light transmittance through the sheet of paper from a light source positioned above the sheet of paper. Each phototransistor consists of a relatively large silicon chip (i.e., at least 50 mils×50 mils) with a wide angle of response (i.e., at least 75 degrees). The array of phototransistors is designed to provide a sensing area approximately equal to the physical area of the array.

Each of the phototransistors making up the array contributes to the output from the array and, while each of the phototransistors remain as sensitive to variations in light transmittance as it would if used individually, the overall effect of the phototransistor array is to average out the variations. This averaging effect results in a more constant output signal than that provided by prior art systems having a single phototransistor with a narrow response angle. Although phototransistors have inherent nonlinear characteristics, they are suitable for sensing the presence of more than a single sheet of paper.

In the preferred embodiment a 4×5 phototransistor array is made up of twenty phototransistors connected in parallel. The array is then wired into a conventional interfacing circuit enabling it to trigger and thereby activate the feed interruption controls.

It is, therefore, the primary object of the present invention to provide an improved optical sensor for detection of the presence of more than a single sheet of paper.

Another object of the present invention is to provide an improved device for the detection of more than one layer of paper comprising an array of photosensors.

Another object of the present invention is to provide a self-cleaning sensor assembly.

Another object of the present invention is to provide an improved large area detector for detecting improperly-fed currency paper.

Another object of the present invention is to provide a large area photo detector of simple construction using wide angle silicon chips to produce an averaging effect.

These and further objects and advantages of the invention will be more apparent upon reference to the following specification, claims and appended drawings.

DESCRIPTION OF PREFERRED EMBODIMENT

Figure 1:
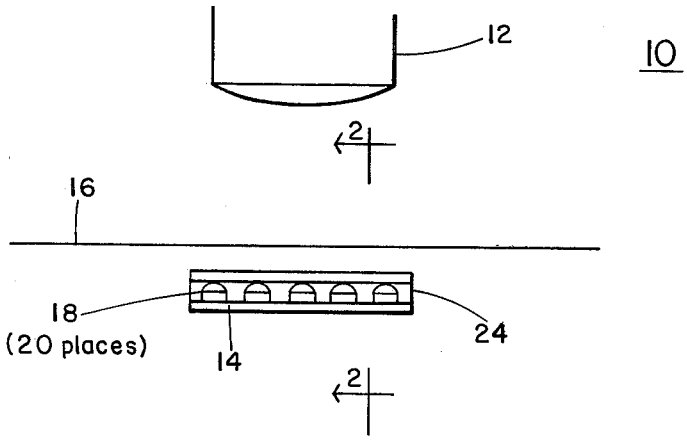
FIG. 1 shows an optical paper control assembly comprising a prior art light source and the optical paper detector in accordance with the present invention.

Referring to the drawings, an optical paper control assembly in accordance with the present invention is generally indicated at 10 in FIG. 1. It comprises a prior art light source 12 and an optical paper detector 14 between which passes a sheet of paper 16. The optical paper detector comprises a 4×5 array made up of 20 phototransistors 18.

Figure 2:
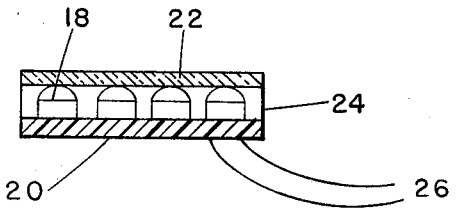
FIG. 2 is a cross-section through the optical paper detector taken along line 2—2 of FIG. 1.
Figure 4:
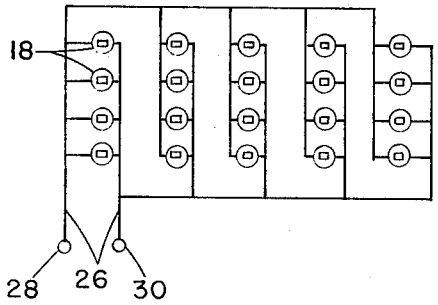
FIG. 4 is a plan view of the 4×5 array of FIGS. 1 and 2.

As can be seen from FIG. 2, the phototransistor 18 as mounted on a printed circuit board 20 joined at the edges to a transparent cover plate 22 made of quartz, pyrex or the like. The cover and printed circuit board are joined by a framework around the edge generally indicated at 24. Leads 26 extend outwardly from the underside of the printed circuit board 20. The leads 26 are shown in FIG. 4 as connecting to the anode terminals 28 and the cathode terminals 30.

Figure 3:
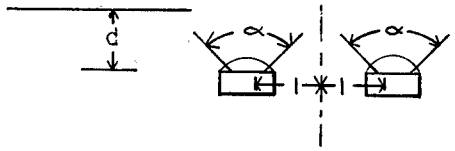
FIG. 3 is a diagram illustrating the various angles and other dimensional parameters for the optical paper detector shown in FIGS. 1 and 2.

FIG. 3 illustrates the geometry of the preferred embodiment of the array. The geometry of the array is a function of the sensing angle $\alpha$ of the individual phototransistor and the inter-element spacing s between the individual phototransistors making up the array. Establishing a particular inter-element spacing s for a phototransistor having a sensing angle $\alpha$ fixes the spacing d between the surface of the array (defined as a plane including the top surface of the phototransistors) and the sheet of paper. For simplicity, let $$s=2l,$$

then elementary geometrical considerations indicate that $$d=l \tan (90-\alpha/2)$$

for $\alpha=75°$ $$d=l \tan 52.5$$

$$d=l\,(1.3)$$

$$d=(0.65)(2l)$$

and expressed in terms of the inter-element spacing s $$d=0.65\ s.$$

Thus, for phototransistors with a response angle of 75 degrees, the sensing area is substantially coincident with the top surface of the array when the distance d is approximately 0.65 s. The phototransistors are connected in parallel and are uniformly spaced. The electrical output of the array will be a function of the average light impinging upon the array. This configuration provides substantially uniform and gap-free sensing over the entire optical sensing area.

FIG. 4 is a plan view of the 4×5 array of FIGS. 1 and 2. The leads 26 are shown in FIG. 4 as connecting to the anode terminal 28 and to the cathode terminal 30 of each phototransistor.

Figure 5:
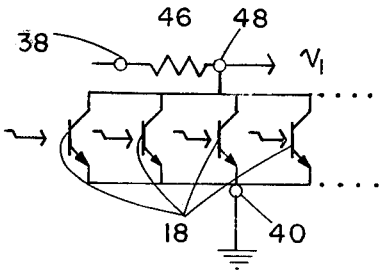
FIG. 5 is a schematic diagram showing the parallel electrical connection of one column of the phototransistors making up the array.

FIG. 5 is a simplified schematic diagram showing the parallel connection of one column of the phototransistors making up the array. The phototransistors are connected between a+5 volt DC power supply connected to terminal 38 and a grounded terminal 40. The individual phototransistors are connected in parallel with each other by means of common lead 42 and the grounded terminal 40. All phototransistors are then connected in series with a load resistor 46. The value of resistor 46 is dependent upon the size and number of phototransistors in the array but for the 4×5 array described herein resistor 46 is 100 ohms. The electrical output $v_1$ from the circuit configuration shown in FIG. 5 is taken from output terminal 48, i.e., between output terminal 48 and ground 40. The individual phototransistors, by way of example only, can be Vactec No. VTT9313 phototransistors which are manufactured by Vatec, Inc. of Maryland Heights, Mo.

Figure 6:
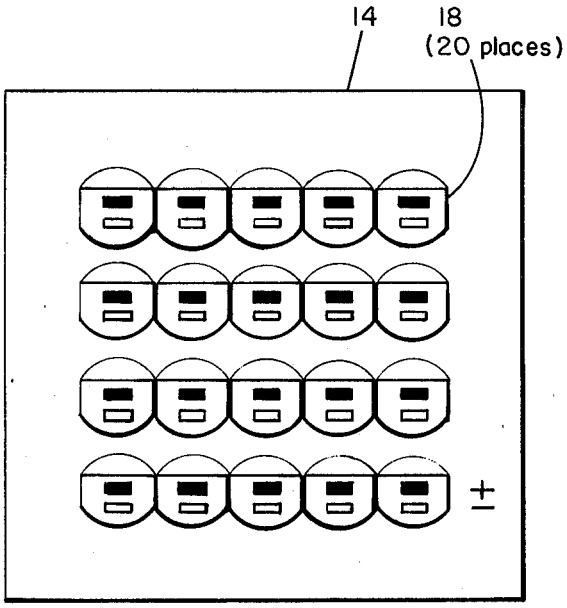
FIG. 6 is a front view showing terminal connections for the 4×5 array.
Figure 7:
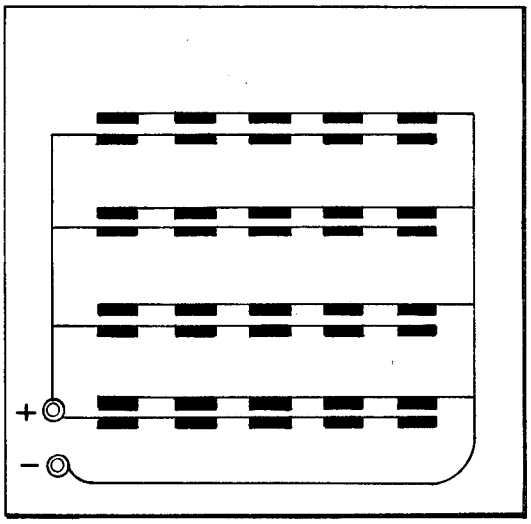
FIG. 7 is a rear view of the array illustrating the electrical interconnection of the individual phototransistors.

FIG. 6 is a front view of the phototransistor array and FIG. 7 is a rear view. As can be seen, particularly in FIG. 6, the phototransistors are arranged in columns and rows such that there are four rows and five columns of phototransistors, for a total of 20 phototransistors to make up the array 14. FIG. 7 shows the rear of the printed circuit board 20 with the terminals 28 and 30 connected to alternate rows of contacts such that all the phototransistors are connected in parallel.

Figure 8:
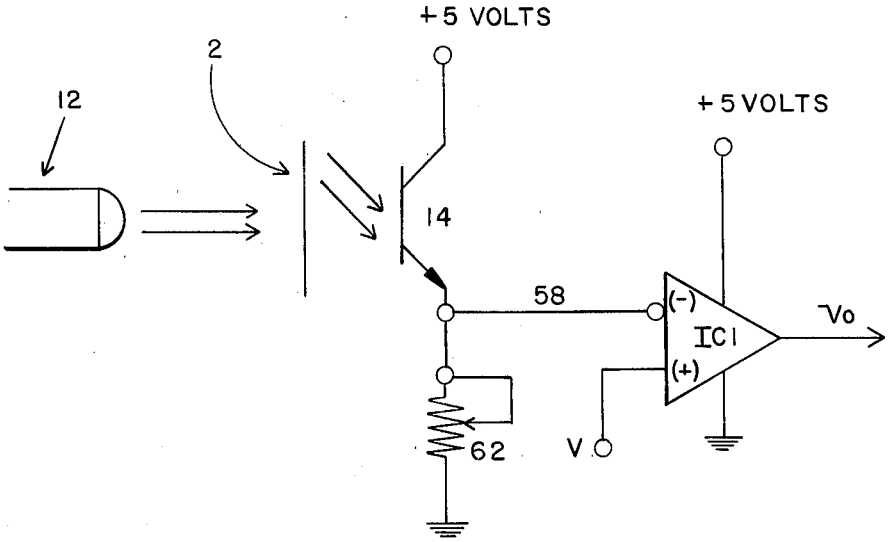
FIG. 8 is a basic circuit diagram of the array and associated interfacing electrical circuitry.

The output of array 14 can be coupled to interfacing circuitry using conventional technology. By way of example and for the sake of completeness, a typical schematic diagram of the prior-art interfacing electrical circuitry associated with a phototransistor paper detector is shown in FIG. 8. For simplicity, array 14 is shown in FIG. 8 as a single phototransistor. The array 14 senses light from the light source 12.

The electrical characteristics of array 14 are such that its effective resistance is a function of the light impinging upon it. More specifically, the effective resistance of array 14 decreases if the light energy impinging upon it increases, and conversely, the effective resistance of array 14 increases if the light energy impinging upon it decreases. Array 14 and potentiometer 62 form a voltage divider network. The voltage that appears on lead 58 depends on the relative magnitudes of the effective resistance of array 14 and the resistance of potentiometer 62. Under quiescent or no-fault conditions, the light impinging on array 14 passes through a single sheet of currency and the array 14 has a certain effective resistance. The resistance of potentiometer 62 is then adjusted to provide a voltage of 4.5 volts on lead 58. This voltage appears at the input (−) of comparator IC1 where it is compared with the reference voltage V applied to the input (+) of ICl.

If the voltage appearing at input (−) of IC1 is greater than the voltage appearing at input (+) of IC1 then the output of IC1 stays low. The reference voltage V is set at approximately 3.2 volts so the output $v_0$ of the comparator remains low while the optical paper detector is sensing a single sheet of currency.

However, if two sheets of currency are introduced between the light source 12 and array 14, the light energy impinging upon the array 14 is reduced; and hence, its effective resistance is increased. This increased effective resistance of the array 14 causes a reduced current in the voltage divider composed of the array 14 and the potentiometer 62. The reduced current reduces the voltage drop across potentiometer 62, and the voltage appearing on lead 58 drops to approximately 2.5 volts. This reduced voltage at the input (−) of comparator IC1 causes the output of the comparator $v_0$ to change from low to high indicating the undesirable condition. Output $v_0$ can be used in various ways to control prior-art feed interrupt systems.

By way of example only, the light source 12 is a General Electric type 1434 operated at approximately 2.1 volts. The operating voltage can be adjusted to provide the desired and proper light intensity. The potentiometer 62 is 600 ohms. The integrated circuit comparator is a LM311.

It is apparent from the above that the present invention provides an improved optical paper detector for detecting the presence of more than one overlying sheet of paper in a feed system. Important features of the invention include the provision of an array of phototransistors having a wide angle of response with the phototransistors positioned relative to each other and to the paper such that a relatively large uninterrupted area of sensitivity is provided which is substantially coextensive with the physical area of the array. A quartz or a pyrex cover plate for the array makes possible a flush mounting arrangement providing a self-cleaning or self-wiping action which prevents dust or dirt buildup as was possible in prior-art systems. The phototransistors are connected in parallel to produce an averaging effect over a relatively large area such that the optical paper detector is rendered relatively insensitive to light transmittance variations due to small misalignments of the sheet of paper or to relatively large localized variations in the density of the paper or to a combination of both variations.

While there has been shown and described an improvement in connection with certain specific embodiments, it will, of course, be understood that it is not intended nor wished to be limited thereto, since it is apparent that the principles herein disclosed are susceptible of numerous other applications, and modifications may be made in the structural arrangement and in the instrumentalities employed herein without departing from the spirit and scope of this invention as set forth in the appended claims.

I claim:

1. In an improved optical paper control assembly wherein a light source and an optical paper detector are adapted to sense the presence of more than a single sheet of paper to be printed wherein said improvement comprises an improved optical paper detector, said improved detector comprising a planar array of photosensors having individual sensing angle $\alpha$, substantially equal to 75 degrees, said photosensors being spaced from each other a first distance substantially equal to s and from said paper a second distance d substantially equal to 0.65s where d and s are related to $\alpha$ by the following relationship $$d=s/2 \tan (90^\circ-\alpha/2)$$

where said array is responsive to light transmittance through a continuous area of said paper which is substantially coincident with the physical area of said planar array.

2. In an optical paper control assembly according to claim 1 wherein said improved detector further comprises a transparent cover over said array, said cover located between said array and said paper such that said paper passes over said cover in a self-cleaning manner.

3. In an optical paper control assembly according to claim 2 wherein said photosensors are phototransistors.

4. In an optical control assembly according to claim 3, wherein said phototransistors are connected in parallel.

5. In an optical paper control assembly according to claim 4 wherein said improved detector comprises a $4\times5$ array of phototransistors.

6. In an optical control assembly according to claim 2 wherein the output of said array is connected through interface circuitry to the interrupt circuit of the feed system of a printing press.

7. In an optical paper control assembly according to claim 6 wherein said cover plate is made of transparent pyrex glass material.

8. In an optical paper control assembly according to claim 6 wherein said cover plate is made of quartz.

* * * * *